US005524861A

United States Patent [19]

Solomon

[11] Patent Number: 5,524,861

[45] Date of Patent: Jun. 11, 1996

[54] REUSABLE MOLD FOR CONSTRUCTING HOUSING UNITS AND METHOD OF USE THEREOF

[75] Inventor: Anthony M. Solomon, McLean, Va.

[73] Assignee: Modal Systems, Inc., McLean, Va.

[21] Appl. No.: 231,230

[22] Filed: Apr. 22, 1994

[51] Int. Cl.[6] ..... E04G 11/02; B22C 9/24; B41B 11/56; B28B 7/30

[52] U.S. Cl. ..... 249/27; 249/33; 249/152; 249/161; 249/170; 249/178

[58] Field of Search ..... 249/18, 27, 33, 249/161, 152, 178, 180, 219.1, 170

[56] References Cited

U.S. PATENT DOCUMENTS

| | | | |
|---|---|---|---|
| 1,694,292 | 12/1928 | Tracey | 249/27 |
| 2,511,584 | 6/1950 | Hill | 249/33 |
| 3,558,095 | 1/1971 | McNeil | 249/13 |
| 4,519,570 | 5/1985 | Strickland et al. | 249/194 |
| 4,570,896 | 2/1986 | Strickland et al. | 249/27 |
| 4,890,999 | 1/1990 | Del Monte | 425/439 |
| 4,944,664 | 7/1990 | Allred | 425/63 |

*Primary Examiner*—Robert J. Warden
*Assistant Examiner*—Christopher Y. Kim
*Attorney, Agent, or Firm*—Veal & Marsh

[57] ABSTRACT

A system of mounting a plurality of wall panels to a soffit layout which defines the building module's layout, utilizes exterior and interior wall panels which are hingedly mounted at the bottom and are actively displaced to permit the casting to be removed. The panels are movable through the use of manual or hydraulic actuators. When the interior panels are positioned to receive the mold material they are exactly vertical. To permit the creation of orthogonal corners, the invention employs a trapezoidal corner panel for use in each interior corner. This corner panel is movable independently of the wall panels although it fits in precise confronting relation with specially designed terminal sections of the wall panels. A spacer or filler segment is also utilized above each interior wall panel and outwardly of the marginal roof panels with the filler segment defining a horizontal junction for the casting wall and roof.

18 Claims, 11 Drawing Sheets

REUSABLE MOLD FOR CONSTRUCTING HOUSING UNITS AND METHOD OF USE THEREOF

FIELD OF THE INVENTION

The present invention relates to modular building units, and more particularly to concrete modular building units. In greater particularity, the present invention relates to the molds and components used in fabricating the modular building units. In still greater particularity, the present invention relates to molds for casting concrete building modules which employ a plurality of wall and roof components which can be selected to provide a plurality of wall lengths and configurations to enable a series modular components to be cast in multiwall and ceiling/floor forms. In even greater particularity, the present invention is directed to a movable monolithic mold system which allows for the casting of modular building units which can be lifted from the mold without the necessity of removing the inner mold components, thereby simplifying and expediting the construction process.

BACKGROUND OF THE INVENTION

Numerous attempts to prefabricate building units or to create buildings from modular units are known to have been undertaken. It has long been recognized that modular construction would be advantageous in situations where large numbers of relatively inexpensive three dimensional building units were needed and where such units be produced in a uniform manner. To that end, prefabricated portions of buildings such as trusses and wall sections are commonly employed. However, the inventor herein is unaware of any successful undertakings wherein a complete unit, including both interior walls and roof, have been cast, integrally in three dimensional monolithicly in concrete in a modular form that was both esthetically pleasing and commercially viable. U.S. Pat. No. 4,180,233 is the most advanced prior art reference known to the inventor and purports to solve the many problems associated with this type construction. The '233 patent noted that one problem with such constructions was the inability to disengage internal mold parts without forming the walls at an angle which was considered undesirable. Yet, '233 was unable to solve this dilemma, as is shown by FIG. 2 of the patent and the improvements shown in FIGS. 12–17. The improvements attempted to make the release of the inner mold components "automatic". It is submitted that the approach outlined therein is not workable inasmuch as positive action to remove the internal mold walls from the casting is required to successfully extract the casting from the mold. This is accomplished in the present invention in a manner which produces a superior casting in terms of its esthetic appearance and in terms of the reusability of the mold. That is to say, the prior art produced only fixed rectangular mold units which were not alterable and could not be reconfigured for further use. Thus, the cost of such units was prohibitive to amortize on a single project and there was no means to provide variation in building style.

SUMMARY OF THE INVENTION

It is the principal object of the present invention to facilitate the construction of cast concrete building in modular form.

It is the further object of the invention to produce such castings in a reusable mold system which can be rapidly reused such that numerous castings can be fabricated and positioned for use as dwellings or portions of building units.

Yet another object of the invention is to provide a molding system which can provide upright interior walls and true corners in a casting and can be reconfigured to provide modular castings in a different layout.

These and other features and advantages of the present invention are accomplished through the use of a novel system of mounting a plurality of wall panels to a soffit layout which defines the building module's layout. In the present invention, wall panels are comprised of a plurality of segments of varying widths such that the wall panel may have an over-all length dependent on the number and dimensions of the wall segments selected. The invention utilizes exterior and interior wall panels which are hingedly mounted at the bottom and are actively displaced to permit the casting to be removed. The interior panels are movable through the use of a manual or hydraulic actuator, whereas the exterior panels are movable via hydraulics only. When the interior panels are positioned to receive the mold material, they are exactly vertical. To permit the creation of orthogonal corners, the invention employs a trapezoidal corner panel for use in each interior corner. This corner panel is movable independently of the wall panels although it fits in precise confronting relation with specially designed terminal sections of the wall panels. A spacer or filler segment is also utilized above each interior wall panel and outwardly of the marginal roof panels with the filler segment defining a horizontal junction for the casting wall and roof. This segment is not affixed to the wall or roof panels when the mold is opened, but is latched to the wall panels while the mold material is retained in the mold.

Due to the absence of consumable parts of the mold and the ease with which the mold components open and close, a quick setting concrete can be utilized in the invention to produce a new casting every 8 to 12 hours, thus, with the use of the present invention an entire community can be effectively provided with building units in a relatively short period of time.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Referring to the figures for a better understanding of the invention, a description of the utilization of the method encompassed by this invention and the apparatus employed therein is provided. It is noteworthy that the present invention contemplates utilization at a building site or in close proximity thereto such that modular building units can be cast and set without substantial expense in transporting the modules in commerce. To that end, it is to be understood that the most efficacious use of the invention will be in areas where large numbers of similar building units will be employed, such as apartment dwellings and similar multi-family units, prison units, schools, hospitals, hotels, motels and the like. Accordingly, it is anticipated that a dedicated concrete plant will be erected on site to service the needs of the invention. It is further contemplated that a factory shelter of some type may be erected to allow the utilization of the invention to proceed continuously.

Figure 2:
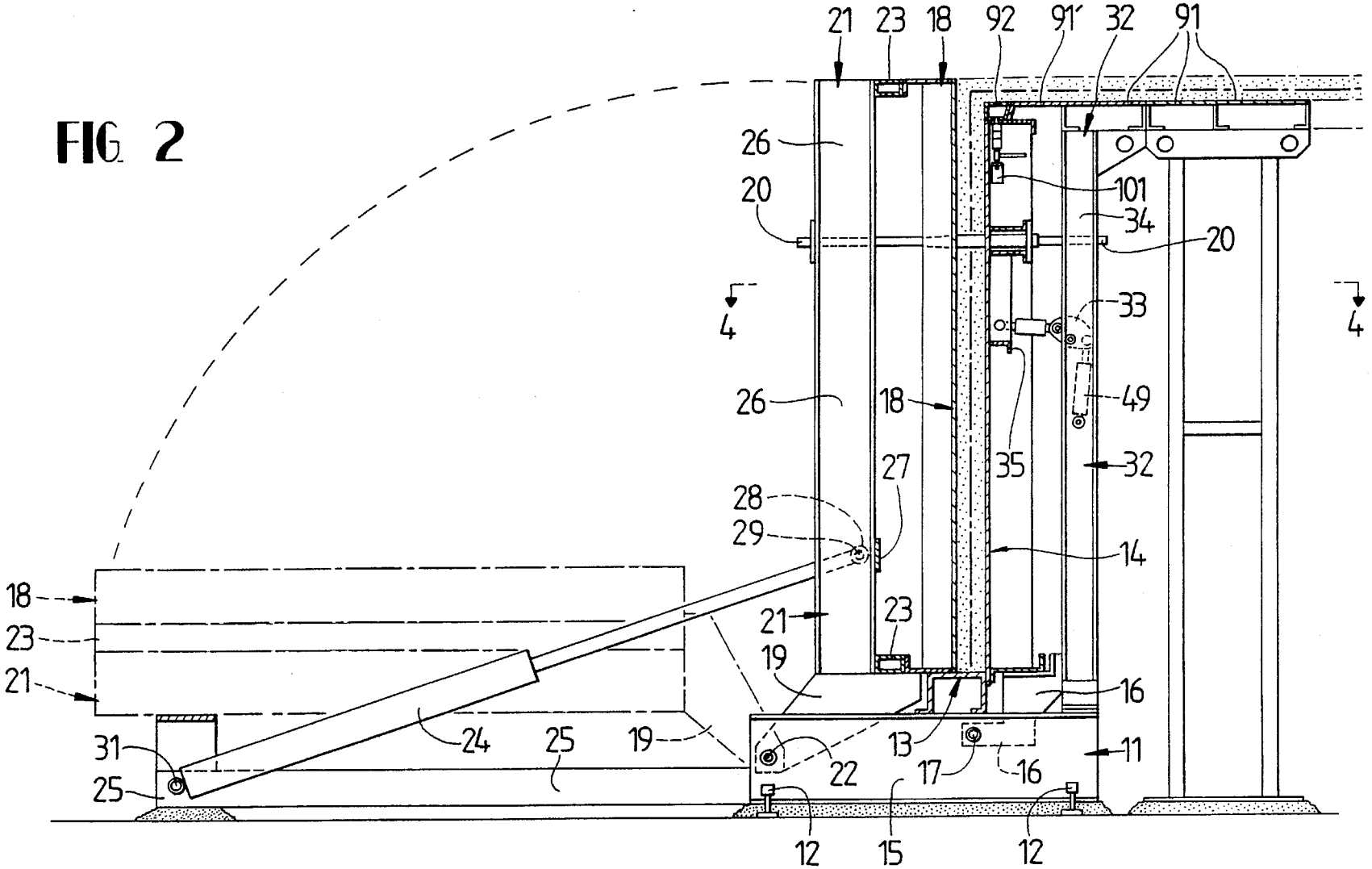
FIG. 2 is a sectional view of the interior and exterior panels in conjunction with the soffit.

The present invention allows the builder a variety of choices in configuration of the modules to be cast; however, it is anticipated that a number of duplicate modules will be constructed and combined by stacking or by abutment to create a larger structure. Thus, although a number of different modules can be cast, when a particular layout of a module is selected the apparatus is intended to be reused as many times as necessary to construct the required number of units. Accordingly, once a building site has been selected and a modular layout determined, the specific components needed to build a mold to form the modules are selected and transported to the building site. These components include exterior wall panels, exterior corner connectors, exterior wall lifts, soffits, interior wall panels, interior corner members, interior wall lifts, roof panels and supports and the associated ties and connectors. The factory site is prepared and a base member 11 is positioned. The base member 11 is preferentially an adjustable platform mounted on a set of leveling jacks 12 and provided with a plurality of connection points at which the soffit members 13 may be mounted. In the present invention, the panels are provided in various sizes such that the dimensions of the module may be selected by abutting panels of selected dimensions. By way of example, panels having variations in widths in multiples of 10 centimeters, e.g. 10 cm, 40 cm, 60 cm and 80 cm can be used to create a wall or wall segment of 10 cm to up to 1520 cm in ten centimeter increments. Wall segments of 1520 cm are approximately fifty feet in length which is adequate for most modular construction projects; however, the present invention may be used to create greater lengths if necessary. A plurality of soffit members 13 are supported on the base 11 on brackets 15 at an elevation and in accordance with the dimensions of the module. The soffit members 13 are approximately 10 inches wide to accommodate casting building walls of between 10 and 23 cm in thickness. As seen in FIG. 2, the soffit members 13 serve as the reference for the remainder of the mold construction, serving as the bottom confinement member on which the walls are poured.

Figure 3:
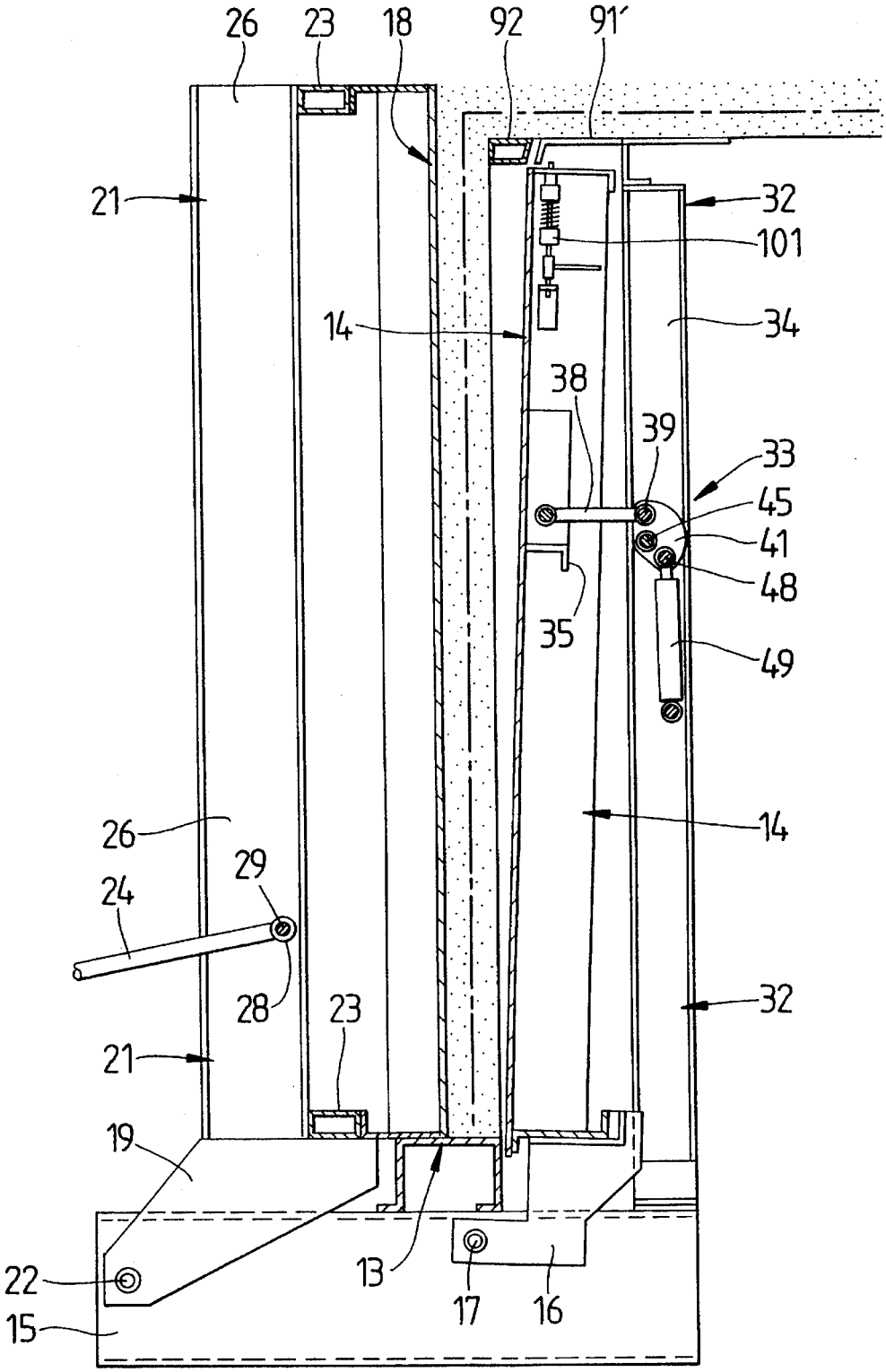
FIG. 3 is an enlarged sectional view showing the interior wall panel in the open position.
Figure 4:
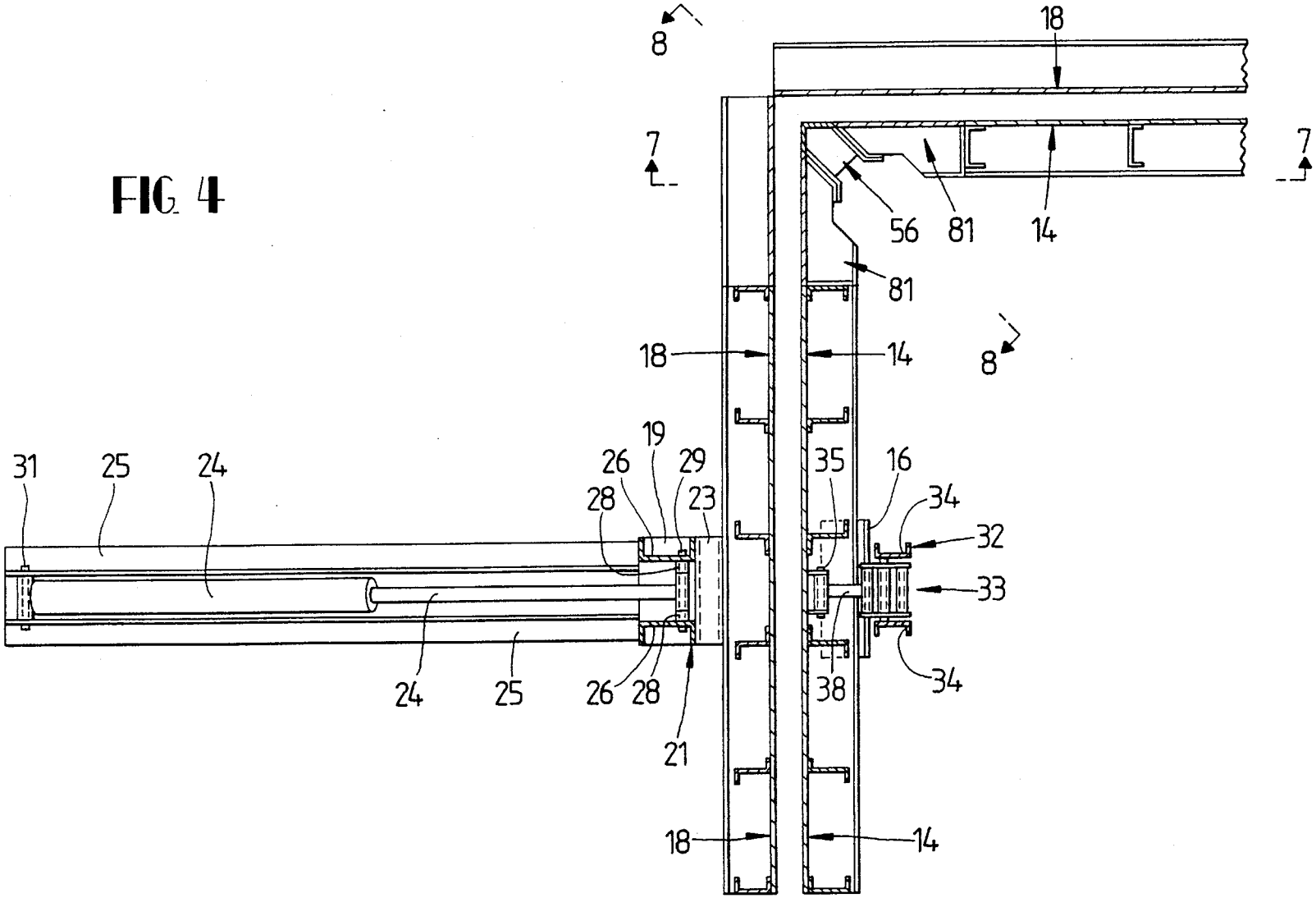
FIG. 4 is a sectional view taken along line 4—4 of FIG. 2.

Interior wall panels 14 are mounted on hinge footings 16, suspended from brackets 15 on a pin 17 such that the interior wall panel 14 can pivot inwardly about a horizontal axis aligned with the longitudinal axis of the supporting soffit member 13. The exterior wall panels 18 are carried on a pivot footing 19 which also carries an exterior waler frame 21. Pivot footing 19 is mounted for selective pivotal movement about pin 22 supported in spaced relation to the soffit 13 outwardly therefrom on bracket 15. The separation between the waler frame 21 and the outer wall panels 18 is maintained by a spacer 23, which is also carried on the pivot footing 19. Increasing the separation between the waler 21 and the outer panel 18 causes the outer panel 18 to be carried by the footing 19 to a position above the soffit member 13 closer to the position of the inner panel 14 which is pivoted into abutment with the inner edge of soffit member 13, thereby decreasing the thickness of the wall to be formed in the mold. As is readily seen, the dimension of spacer 23 may be varied to inversely vary the thickness of the wall to be formed. The exterior waler 21 is affixed to an actuator 24 which is mounted to a transverse pin 29, as shown in FIG. 3, carried by the waler 21 and to an actuator bracket 25 which extends outwardly from bracket 15. In actuality, bracket 15 and bracket 25 are bolted together and anchored to the base 11 such that elongation and retraction of the actuator 24 results in movement of the pivot footing 19 about pin 22, thereby moving the exterior wall panel 18 selectively to an open position and a closed position. As may be seen in FIGS. 2 and 3, each of the exterior walers 21 (note that several may be employed along one wall) utilizes a pair of upright channel members 26 mounted to pivot hinge 19 and joined by at least one transverse plate 27 and other cross members. Each channel member 26 carries a tube 28 which extends parallel to pin 22, with the tubes 28 aligned to receive therethrough a pin 29 which in turn is connected to the associated actuator 24. In like manner, the opposite end of the actuator 24 is connected to the bracket 25 with a pin 31.

Figure 5:
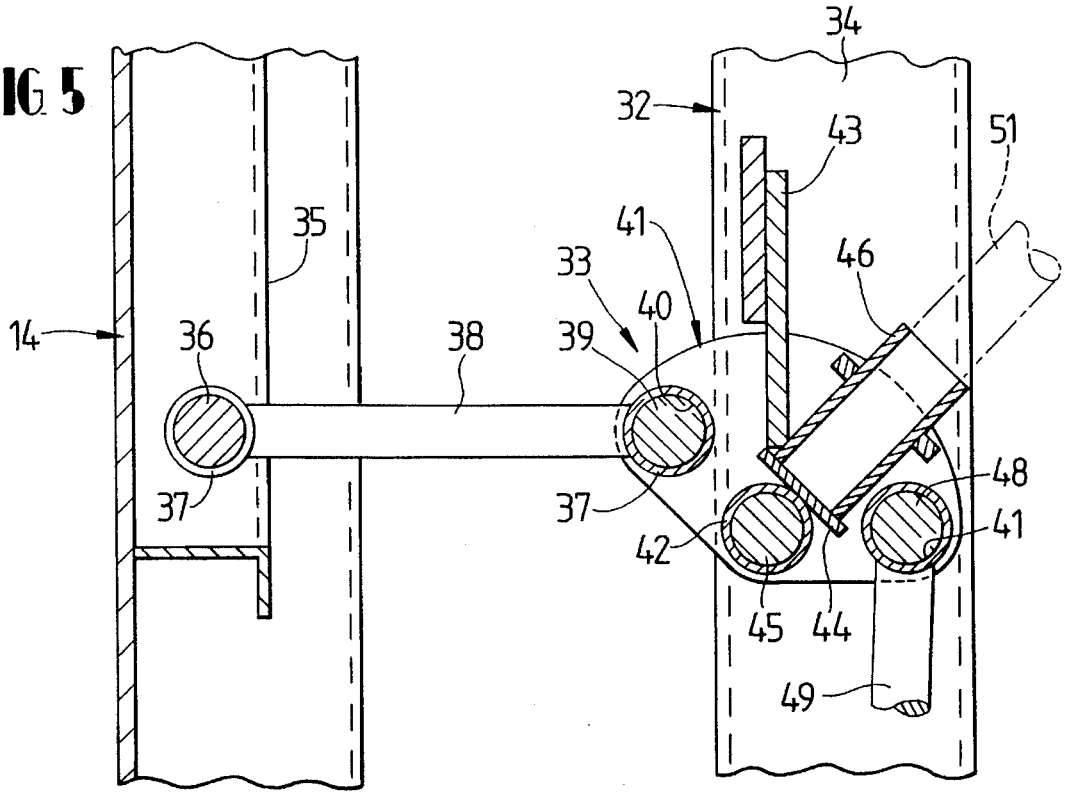
FIG. 5 is a sectional view of the actuator for the interior panels.
Figure 6:
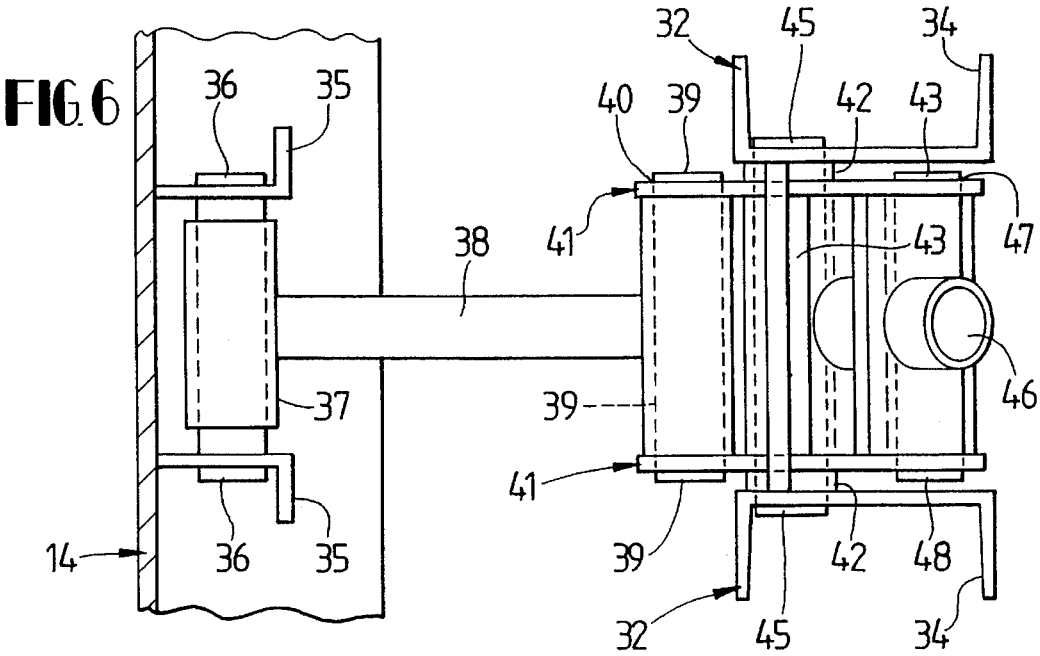
FIG. 6 is a plan view of the actuator for the interior panels.

Interior walers 32 are provided as seen in FIGS. 2 and 3 and are mounted to bracket 15 inwardly of the soffit members 13. While external walers 21 are rigidly connected to exterior wall panels 18 via spacers 23, the interior walers 32 are intended to remain stationary and are connected to the interior wall panels 14 by pull-back actuators 33 as shown in FIGS. 3, 5 and 6. The interior walers 32, like the exterior walers 21 are made up of mutually outwardly facing channel members 34 which are connected by plates and other structural crossmembers. The pull back actuators 33 are affixed to the wall panels 14 at a pivotal connection wherein a bracket 35 supports a horizontal pin 36 parallel to the wall panel 14 surface. A sleeve 37 is mounted about the pin 36 and affixed to one end of an actuator rod 38. The rod 38 is connected at its other end to a second sleeve 37 which receives therethrough an actuator pin 39. Rod 38 is adjusted in length to fine tune the wall position. Actuator pin 39 is carried in a pair of aligned apertures 40 in a pair of pivotally mounted pullback plates 41 which are in turn carried intermediate the channel members 34 of the walers 32. The plates 41 are cooperatively mounted on a pivot tube 42 and to a transversely extending locking plate 43 which is aligned with the pivot tube 42. A pullback pin 45 extending through a pair of aligned apertures in channel members 34 extends through pivot tube 42 and supports the pullback assembly. An actuator plate 44 is mounted to the plates 41 tangentially to the tube 42 and in angular abutting relation to locking plate 43. A receiving tube 46 is mounted normally to the actuator plate 44 such that the longitudinal axis of the receiving tube 46 extends radially from pivot tube 42 and is offset from actuator pin 39 by ninety degrees. Plates 41 additionally have defined therein aligned apertures 47 located at an angular displacement of about 135 degrees as measured about pivot tube 42 from apertures 40. An auxiliary pin 48 may be received in these apertures 47 for the attachment of a linear actuator 49 which would also be attached to the waler 32. By extending or retracting the linear actuator 49, the plates 42 and the actuator pin 39 would be urged about the pullback pin 45, thereby selectively urging the upper portion of the interior wall panel 14 to a closed or open position. Likewise, a lever 51 may be inserted into receiving tube 46 to allow manual application of force to rotate the pullback assembly 33 and selectively position the interior wall panels 14.

It will be appreciated that the interior of the mold will form corners. It will also be appreciated that the use of two orthogonal wall panels at the interior corners will create an interference when both wall panels are to be positioned in the open position which must occur to remove the casting from the mold. Prior systems known to the inventor have required the total removal of the wall panel segments adjacent the corners to facilitate removal of casting or have produced castings in which the walls and ceiling are not orthogonal, which creates additional difficulties. An important feature of the present invention is a corner panel which eliminates the problem of interior corners.

Figure 8:
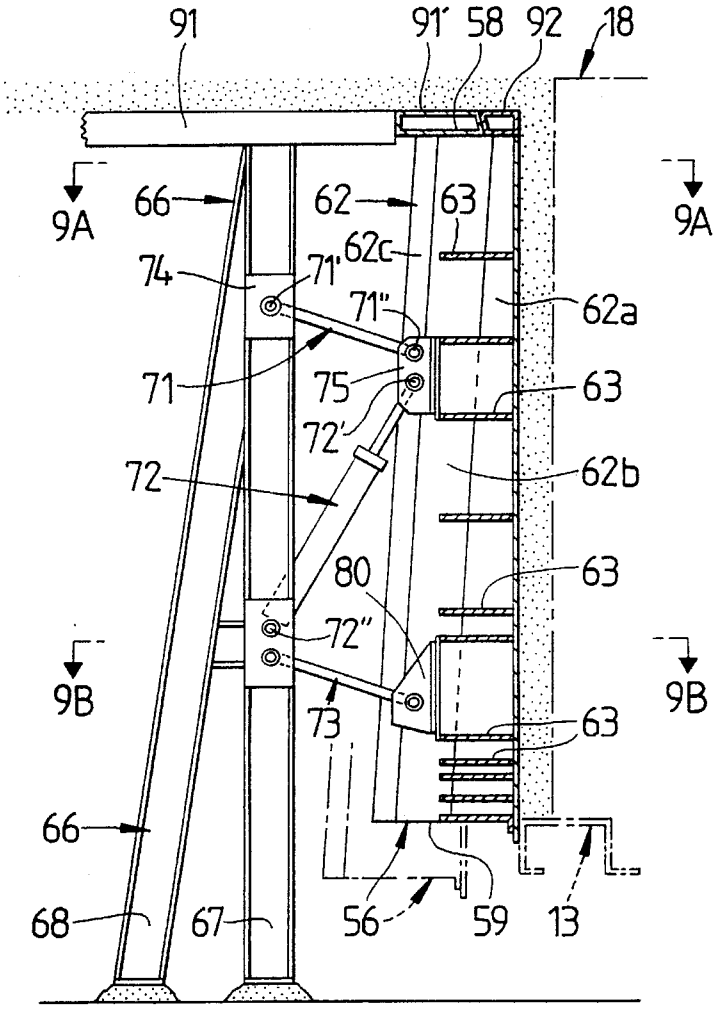
FIG. 8 is a sectional view of the corner panel and waler attached to each other, taken along line 8—8 of FIG. 4.
Figure 7:
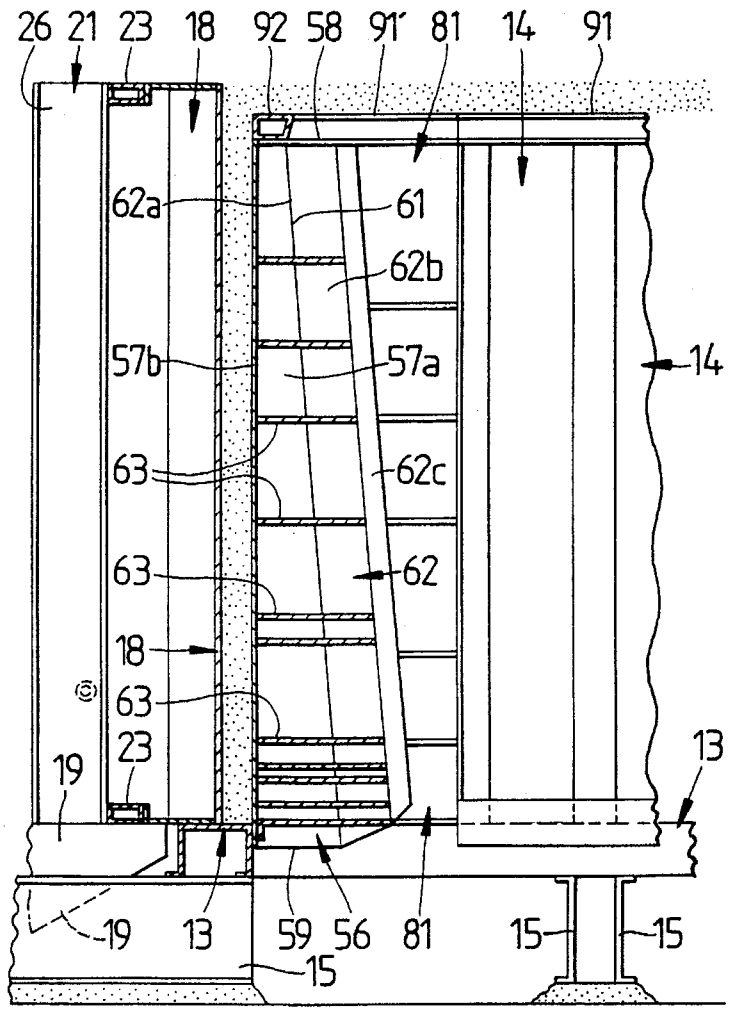
FIG. 7 is a sectional view of a corner panel taken along line 7—7 of FIG. 4.
Figure 9A:
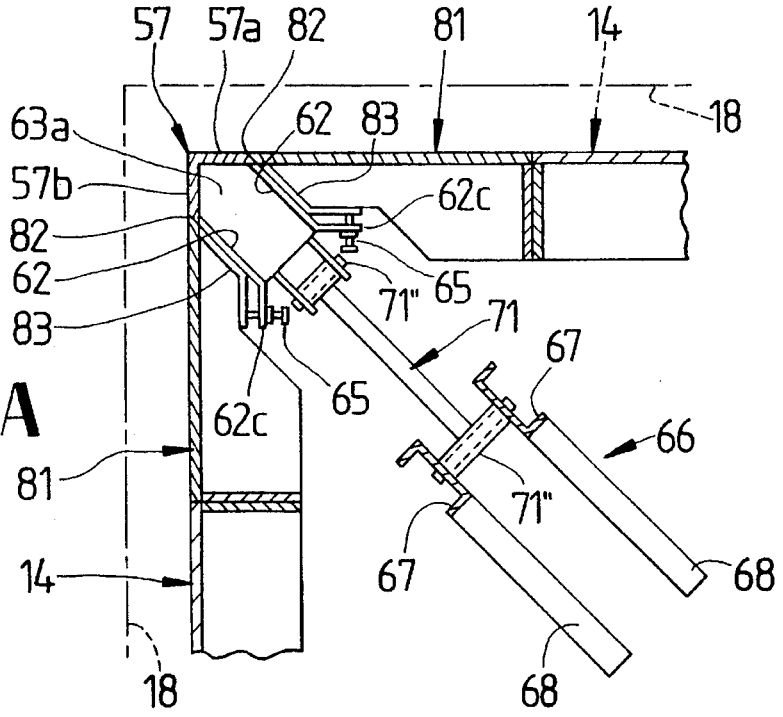
FIGS. 9A & 9B are sectional views of the corner panel at different heights.
Figure 9B:
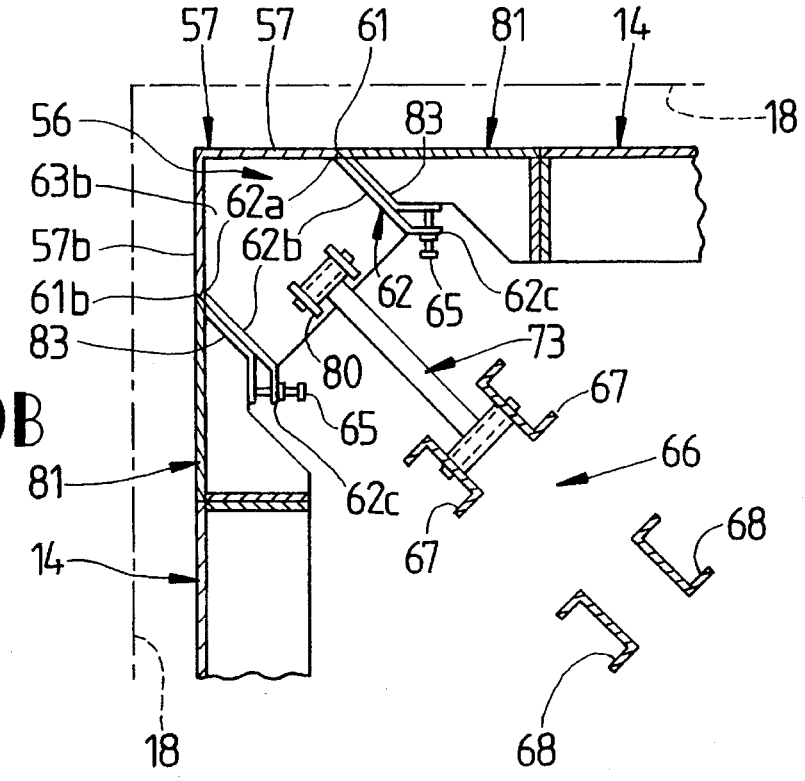
Figure 9D:
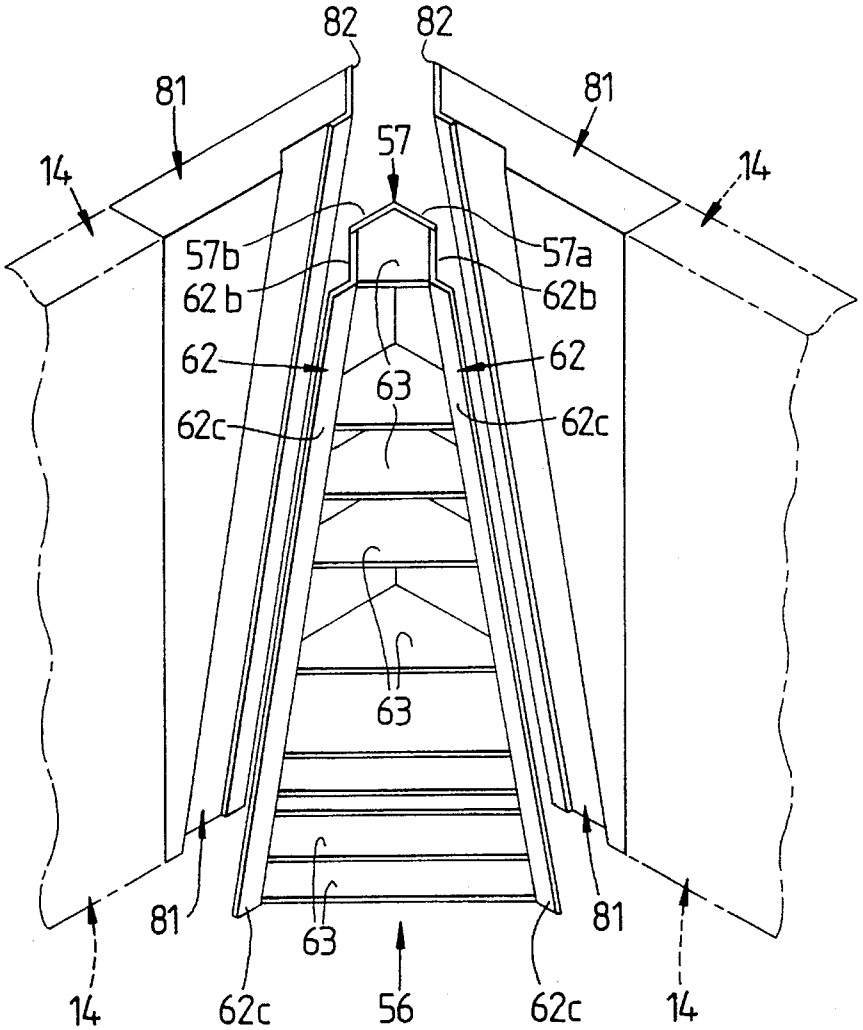
FIG. 9D is an internal perspective view of a corner panel with certain parts omitted for clarity.
Figure 9C:
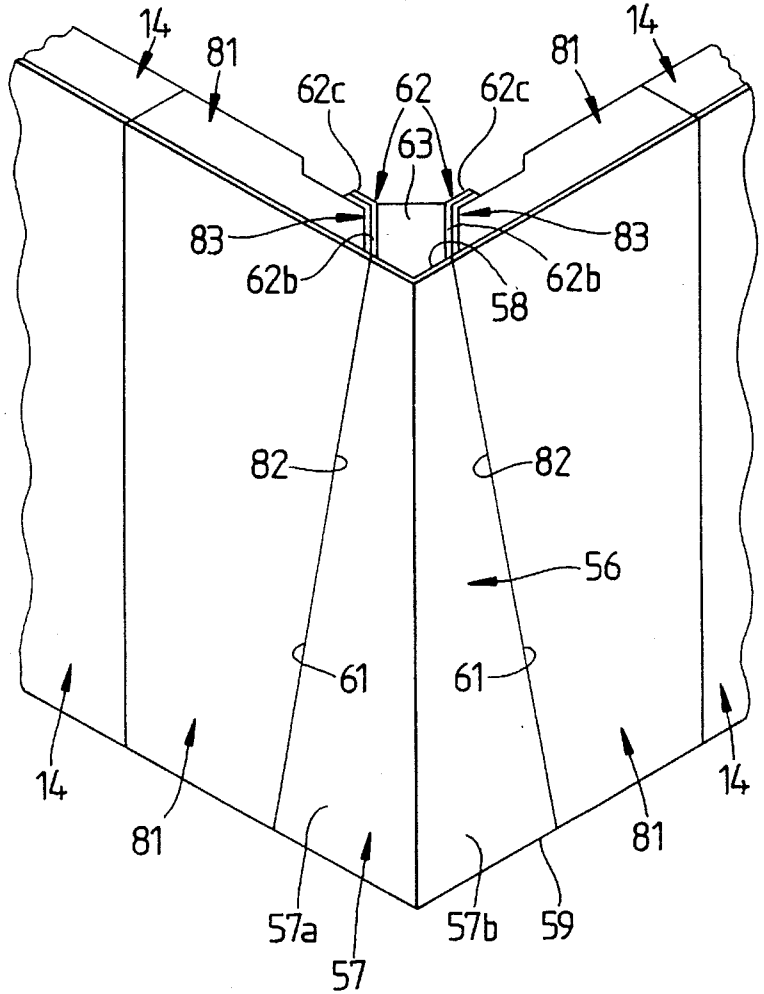
FIG. 9C is an external view of a corner panel and adjacent interior wall panels.

As may be seen in FIGS. 7–9, the corner panel 56 is a wedge shaped weldment, including a corner plate 57 which defines a right angle vertical corner for the mold. Corner plate 57 has a top edge 58 and bottom edge 59 dimensioned such that the top edge 58 is shorter than the bottom edge 59, such that when the plate 57 is deformed along its longitudinal axis to form a right angle, each half, 57*a* or 57*b* of the plate 57 extending from the corner forms a truncated triangle and lateral opposing edges 61*a* & 61*b* of the plate 57 diverge from top to bottom. Each lateral edge 61 has affixed thereto an abutment plate 62 which is trapezoidal in shape and which is formed with two distinct portions divided by a bend line which extends parallel to the associated lateral edge 61. The abutment plates 62 are affixed with a longitudinal edge 62*a* adjacent lateral edge 61 and to form an inclined portion 62*b*. Inclined portion 62*b* extends inwardly of the mold at an angle of about 45 degrees from plate half 57*a*. Thus, inclined portion 62*b* forms an inclined plane of constant width extending upwardly transversely of the adjacent wall section of the mold. A tab portion 62*c*, separated from the inclined portion 62*b* by the bend line, extends parallel to the wall section and plate section 57*b*. The corner plate 57 and the opposing inclined portions of the two abutment plates 62 are joined by a plurality of vertically spaced plates 63, to which a pair of brackets 75 and 80 are mounted. As may be seen from FIGS. 9A, 9B, 9C and 9D, the plates 63 increase in width from the top plate 63*a* to the lower plate 63*b* thus, indicating the increase in sectional area of the corner panel 56 from bottom to top.

The corner panel 56 is positioned by a waler assembly 66 as shown in FIG. 8. The corner waler assembly 66 includes a pair of upright channel members 67 similar to those of the aforementioned walers 32 used with the exterior 18 and interior panels 14 and a set of bracing channels 68 which are affixed to the upright channel members 67 opposite the corner panel 56. The corner panel 56 is attached to the waler assembly 66 by three struts 71, 72 and 73. The upper, 71, and lower, 73, of these struts are adjustable in length to fine tune placement of the corner panel. A jamb nut is used to maintain the desired length; however, the middle strut 72 is variable in length and is preferably a hydraulic linear actuator. Strut 71 is pivotally connected at a first end 71' to an upper bracket 74 affixed to the waler assembly 66 and is also pivotally connected at a second end 71" to a superior bracket 75 affixed to the corner panel 56. Middle strut 72 is also pivotally connected at one end 72' to superior bracket 75 and extends downwardly therefrom to a second end 72" which is pivotally connected to a lower bracket 76 affixed to the upright channels 67. Lower strut 73 is likewise pivotally connected to the lower bracket 76 and extends downwardly to an inferior bracket 80 affixed to corner panel 56. The waler assembly 66 is fixedly mounted to the base 11, thus, as the middle strut 72 is hydraulically elongated or shortened, the corner panel 56 is constrained to move, yet is maintained in a vertically aligned relationship, thus, moving in an arc in a vertical plane toward or away from the corner of the mold. The variable length of the middle strut 72 is selected such that the corner panel 56 moves downwardly and away from the corner of the mold when the strut 72 is hydraulically shortened. As may be seen in FIGS. 8, 9A, 9B, 9C and 9D, a terminal section 81 of the adjacent interior wall panels 14 is a complimentary weldment to the corner panel 56. That is to say the outer surface of the wall section 81 has an edge 82 which abuts edge B/A or B of the corner panel 56 and extends downwardly and away from the corner of the mold. A confronting plate 83 is affixed to the wall section along this edge at an angle such that abutting plate 62 is urged into parallel abutment therewith when the corner panel 56 is urged outwardly and upwardly by the actuator of strut 72. As will be appreciated, the space between orthogonal wall segments 81 adjacent a corner is narrower at the top of the wall than at the bottom thereof. From the foregoing it may be seen that downward and inward movement of the corner panel 56 yields ample room at the top of the interior wall panels 14 to permit orthogonal panels at a corner to be simultaneously tilted inwardly about their respective hinge footings 16 to remove a casting from the mold. Note that adjusting bolts 65 may be used to urge plates 62*c* and 83 into proper aligned relation to properly secure the corner panel for casting the module.

Figure 10:
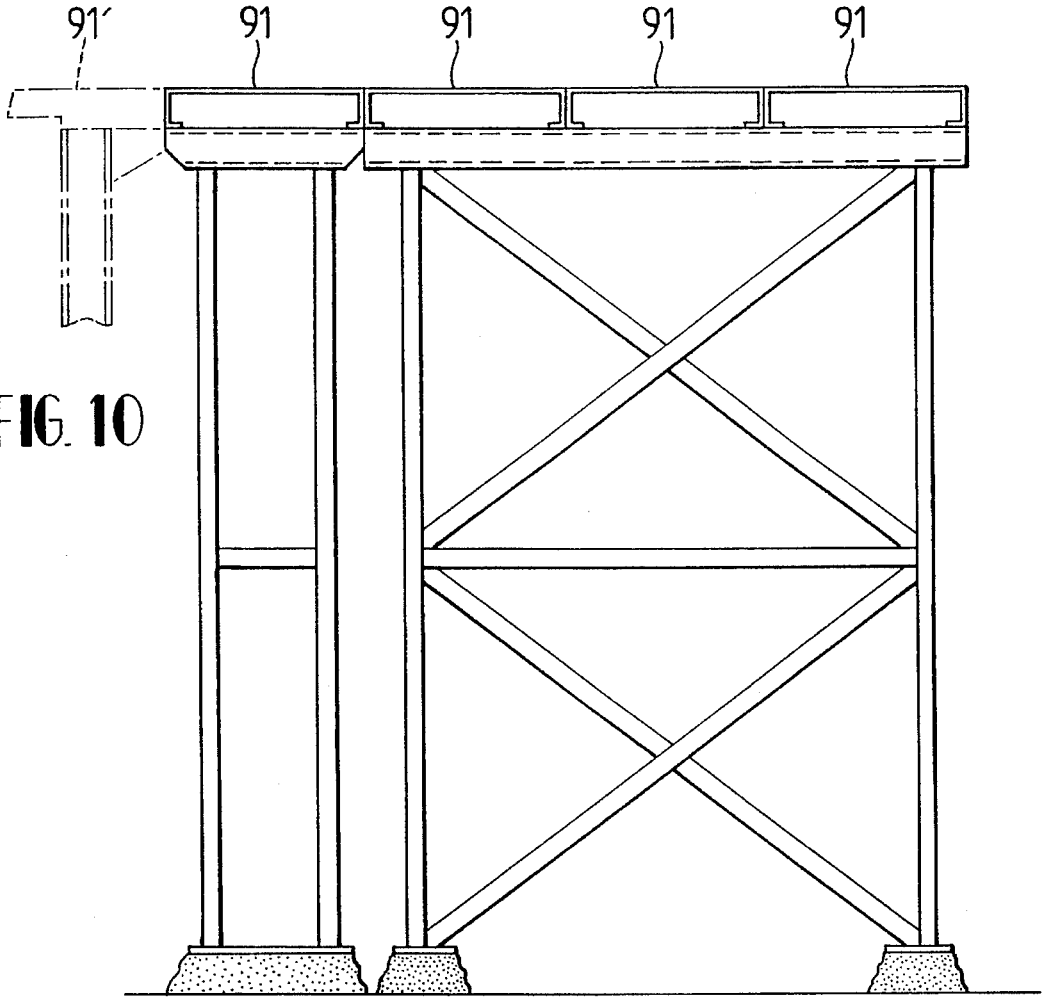
FIG. 10 is partial sectional view of the roof panels and support.
Figure 11:
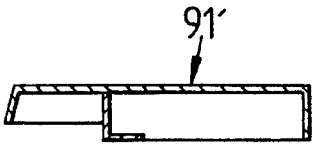
FIGS. 11, 12 and 13 are views of the marginal roof panels showing the adaptation for the filler section.
Figure 12:
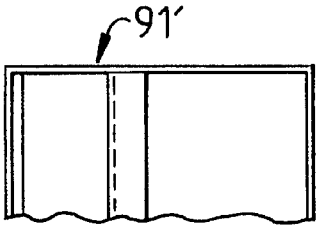
Figure 13:
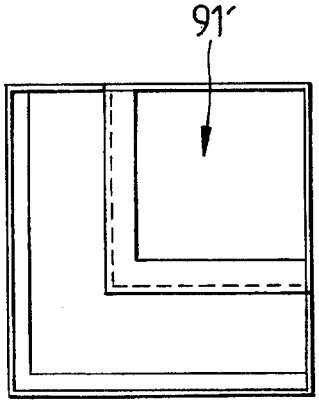
Figure 14:
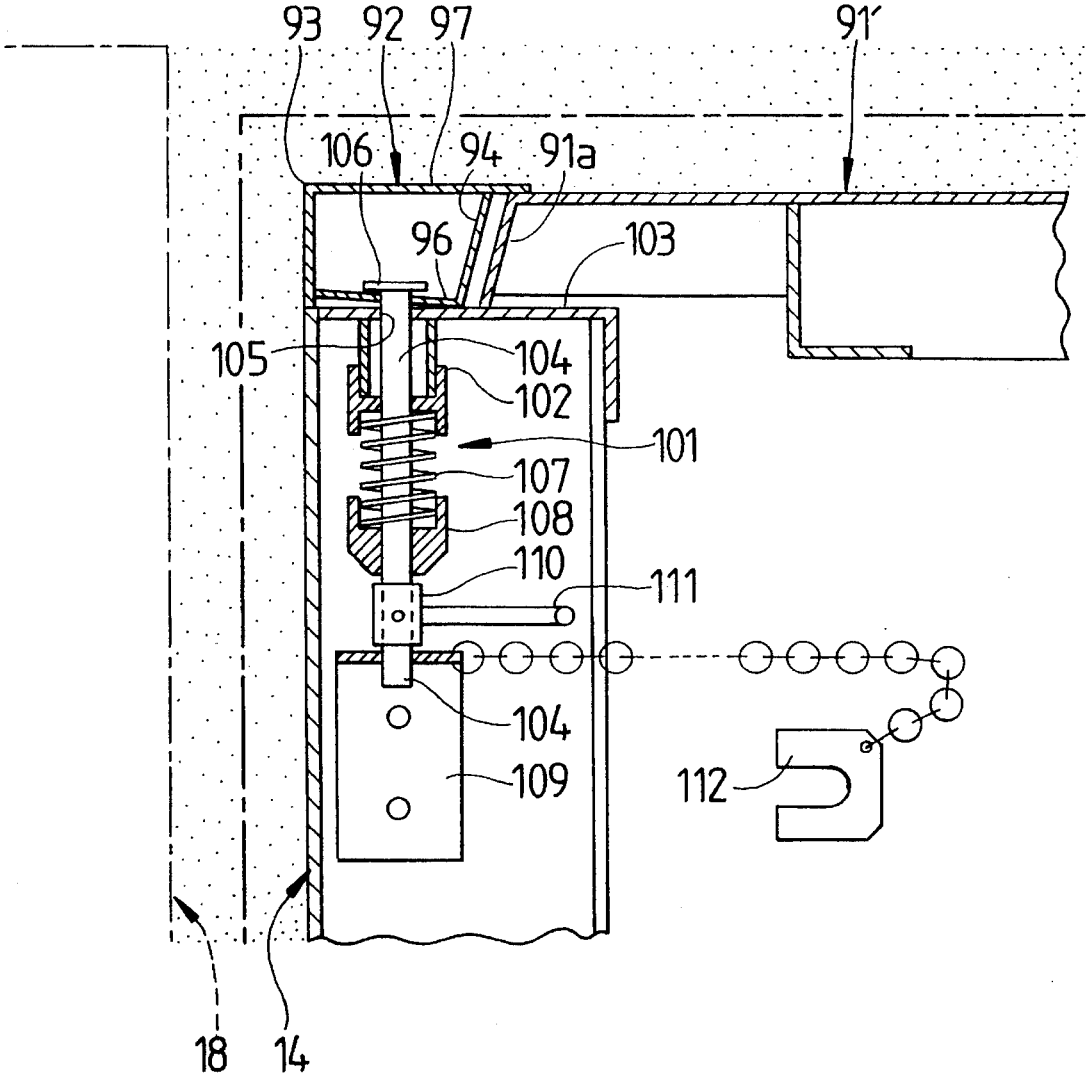
FIG. 14 is a sectional view of the latch for connecting the wall panels to the filler section.

In addition to the wall panels, the mold must include roof panels 91, such as shown in FIG. 10. As will be appreciated, these panels 91 must be supported independently of the wall panels to allow the wall panels to be tilted to remove the casting. The roof panels 91 are fabricated in a variety of weldments of cooperative sizes such that the building to be cast will use a predetermined number of roof panels 91 in accordance with the wall panels selected. It will be appreciated that the interior walers 66 may be attached to the roof panels 91, thereby adding mutual stability to the components; however, it will also be appreciated that the horizontal intersection of the interior wall panels 14 and roof panels 91 creates an interference region when the interior wall panel 14 is displaced from vertical such as during opening and closing of the mold. As seen more clearly in FIGS. 11 and 14, this problem is remedied by the use of marginal roof panels 91' which do not extend completely over the wall panels 14, but rather cooperate with the interior wall panels 14 to form an inset in which a filler segment 92 is positioned. Filler segment 92 is an elongated member which extends along the top of the wall panels 14 and forms a right angle corner 93. The segment is substantially trapezoidal in section with a pair of orthogonal surfaces extending from the right angle corner 93. The surfaces opposite the right angle corner 93 form an obtuse angle, with one surface 94 extending upwardly and away from the corner 93. A somewhat horizontal surface 96 overlies an outermost part of the wall panel and is slightly spaced from the upper edge of the wall panel. Apertures 97 are provided in the upper surface for inserting attachments therethrough such that the segment may be attached to the casting or a wall board placed intermediate the casting and the mold. Each marginal roof panel 91' has an outer plate 91*a* which extends parallel to surface 94. The segments are also held in place during the casting operation by a series of latches 101 mounted in the wall panels 14. As may be seen in FIG. 14, the latch 101 includes a tubular guide 102 affixed to an upper plate 103 of wall panel 14 in cooperative alignment with a slot 105 therethrough. Mounted for axial movement within the guide 102 is a rod 104 carrying a T-head 106 on its upper end. The rod 104 is biased downwardly by a concentrically mounted spring 107 captured between a lower stop 108 carried by the rod 104 and an internal flange formed at the bottom of the tubular guide 102. An L shaped bracket 109 is affixed to an inner structural member of the wall panel 14 and extends horizontally transversely to rod 104, such that the rod 104 is constrained to move within an aperture in the horizontal portion of the bracket 109. A concentric tube 110 affixed to the rod 104 above the bracket 109 carries a handle 111 which can be used to raise and rotate the rod 104. A latch slide 112 is provided to interface with the rod 104, bracket 109 and tube 110 to hold the latch 101 in position.

Figure 1:
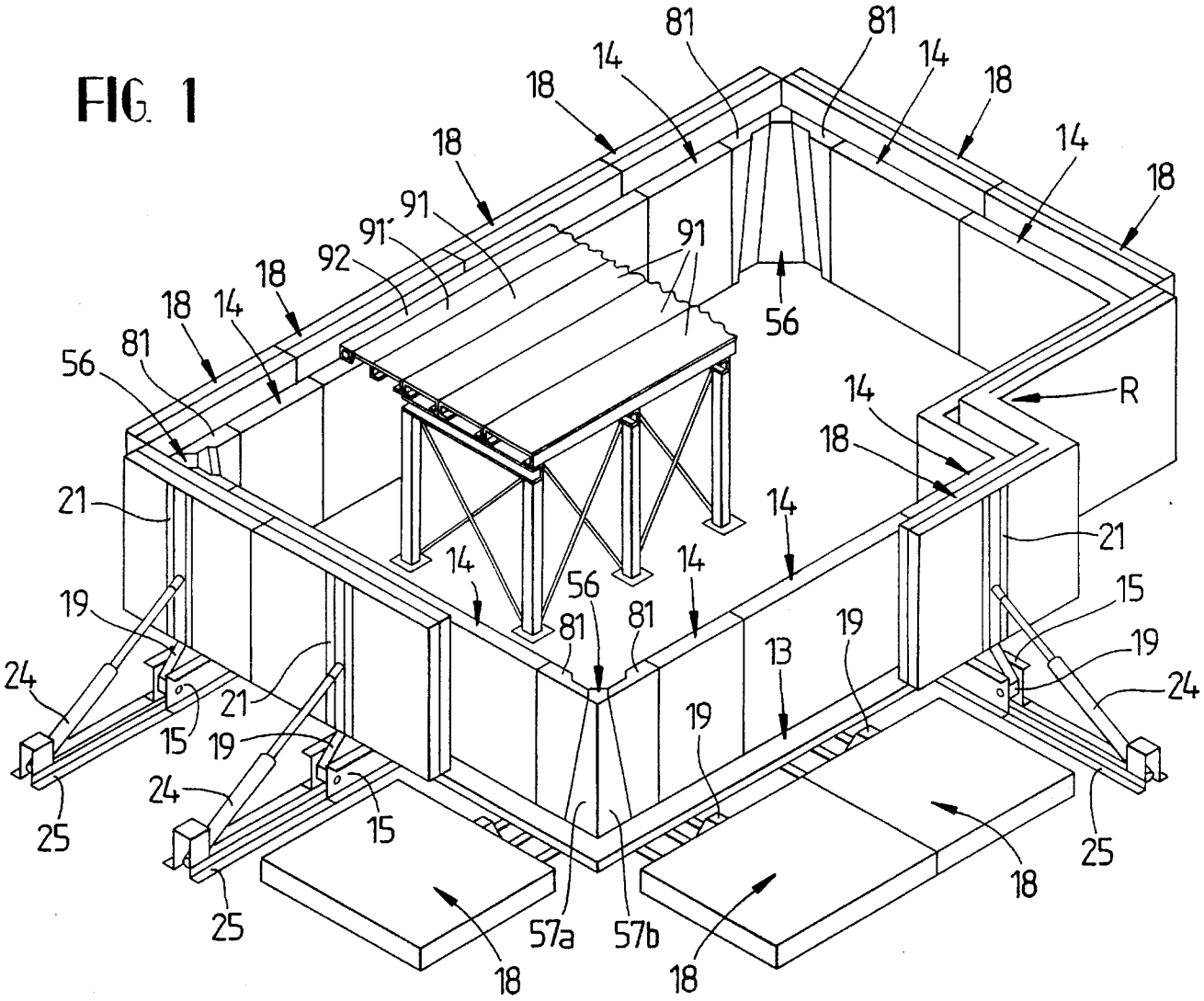
FIG. 1 is a perspective view of the mold as a casting is being prepared.

Additional features of the invention will become apparent from a discussion of the utilization of the invention. Based on the plans for the project, the necessary mold components will be selected and transported to the project site. Various storage and fabrication facilities are erected including a movable factory shelter. The base 11 is positioned on a plurality of leveling jacks and a layout for the anchor bolts for the brackets and other support structures is completed. The mold is then constructed inside the shelter. If desirable, a wallboard shell may be assembled over the inner wall panels 14 and roof panels 91. Blockout inserts are affixed to the wall board to define windows, doors and HVAC conduit positions. Electrical wiring is positioned to the extent possible to provide for connection to the electrical utility. Fast drying rigid urethane foam may then be sprayed over the wall board, HVAC ductwork, and electrical lines. Custom fabricated reinforced steel cages 95 produced on site are installed to reinforce the walls and roof of the casting. The cages 95 are positioned on guides which hold them off the foam surface to insure interstitiation of the concrete. Lifting straps are attached to the cages 95 and extend upwardly at preselected locations about the mold. The exterior walers 21 are used to raise the outer mold panels 18 into position such that tie rods 20 are inserted through the panels as shown in FIG. 2. Rapidly curing concrete is pumped into the mold and integrated with the steel reinforcing cages 95. Such concrete composition is commonly used in the art. Concrete is vibrated and screeded in a conventional manner to insure proper interstitiation around the cages 95 and blocks. By controlling the type of concrete used in the mold, castings may reach sufficient strength for removal within 6 to 8 hours. When sufficient strength is reached, the fabrication shelter is withdrawn (if one has been provided) and a crane is used to attach to the lifting straps which extend slightly above the cast walls. The tie rods are removed and the interior and exterior walls are retracted to their open positions. Note that on return corners, such as at R in FIG. 1, one of the intersecting exterior walls may be simply lifted out to permit lowering of the adjacent wall. A lifting frame is used to connect the crane cables to the casting to properly distribute the lifting forces and the entire casting is then lifted off the soffits and positioned on a carrier or a prepared foundation. Note that the filler segments 92 are lifted with the casting and are not retrieved until the casting is set into place, whereupon they may be retrieved and reused.

As soon as the casting is removed from the mold, the process is repeated, thus as many as three castings can be set in less than twenty-four hours. As each casting is removed from the mold it may be placed in cooperative relationship with earlier castings to form multi-room buildings and even multi-floor buildings, wherein subsequent castings are placed atop earlier castings. In such constructions the superjacent castings may have recesses for receiving the lifting straps of the lower castings and the lifting straps may actually be used to interconnect the reinforcing mats of the two castings. Likewise, the walls and roof of the castings may have cooperative recesses formed therein to provide proper stacking stability. That is to say the top of the lower casting may have a peripheral recess in which a depending cast flange from a superjacent casting may mate to further insure proper fit and stabilization.

Once the desired number of modules have been associated, the interior and exterior finishing of the project may be completed. Interior partitions may be constructed using normal building materials and utility service may be connected using the conduits and wiring placed in the module during construction and augmented as needed.

Figure 15:
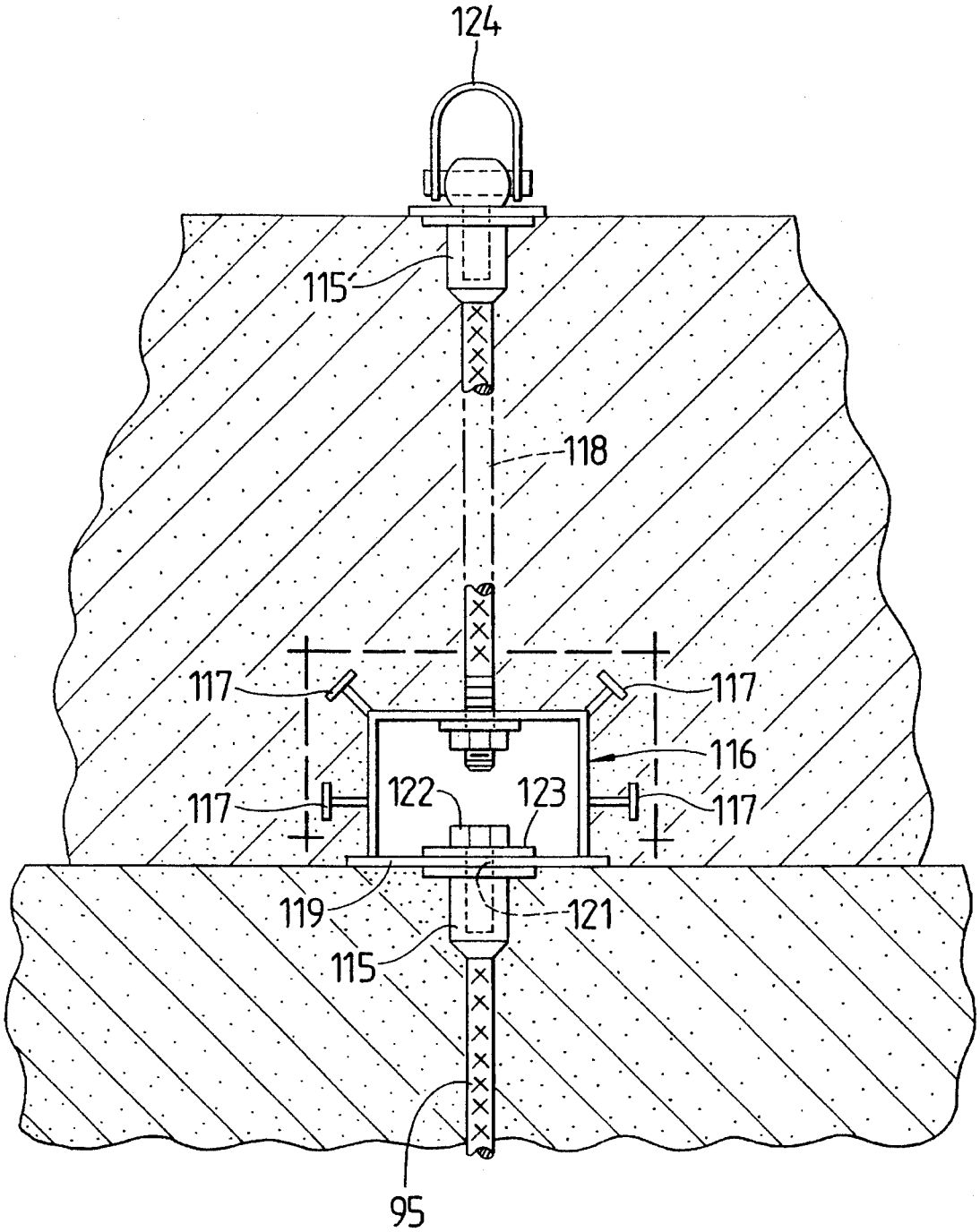
FIG. 15 is a sectional view showing a method of attaching lifting means to a module.

An alternative is shown in FIG. 15, wherein a threaded female cap 115 is affixed to a strand of the metal cage 95 such that the top of the cap 115 is coplanar with the concrete in the mold when screeded. In this embodiment the upper casting has a metal box 116 with a plurality of Nelson Type studs 117 positioned in the mold cavity before the concrete is poured such that the box 116 is affixed to a lifting rod 118 extending upwardly through the casting to a female cap 115. The box 116 includes a bottom plate 119 with an aperture 121 through which a bolt 122 may extend downwardly to engage a subjacent cap 115. A washer 123 is provided circumscribing the bolt 122. During casting, the mold walls form the side walls of the box, thus, after the modules have been stacked, the interior of the box can be grouted as in the prior embodiment.

The connector provides stability to the stacked modules and provide a seismic connection which may be needed in certain areas of the world. As can be seen, the bolt 122 is interchangeable with a lifting loop 124 which can be threaded into cap 115 to lift the modules from the mold.

While I have shown my invention in one embodiment, it will be obvious to those skilled in the art that it is not so limited but is susceptible of various changes and modifications without departing from the spirit thereof.

1. An apparatus for forming a mold for monolithic casting of a building of reinforced concrete, comprising:

(a) a plurality of exterior mold panels defining an outer surface of a set of walls of an integral monolithic casting, said exterior mold panels each having adjacent segments of a predetermined width selected from a plurality of widths, such that a plurality of such segments may be selectively employed to form a wall of a desired length;

(b) activation means for selectively moving selected ones of said exterior mold panels about a first axis parallel and outwardly from said exterior mold panels to a displaced, substantially horizontal position and to a vertical casting position;

(c) a plurality of interior wall panels defining an inner surface of said set of walls, pivotally mounted for limited inward movement about a horizontal axis spaced beneath a lower edge thereof, said interior wall panels having adjacent segments of a predetermined width selected from a plurality of widths such that a plurality of such segments may selectively be employed to form an interior wall of a desired length, wherein orthogonally disposed ones of said plurality of interior wall panels adjacent an interior corner of said mold define upwardly converging, adjacent surfaces; and (d) a corner panel of polygonal shape having orthogonal surfaces defining a corner and spaced apart upwardly converging faces affixed perpendicularly to said orthogonal surfaces for interstitial engagement with said upwardly converging, adjacent surfaces and means for selectively moving said corner panel between an upper engaging position and a lower disengaged position.

2. An apparatus as defined in claim 1 further comprising a plurality of soffit members cooperatively positioned to generally define the bottom of said set of walls; wherein said exterior mold panels are positioned in abutting relationship with said soffit members when in said vertical position, said first axis located downwardly and outwardly from said soffit members and said horizontal axis being beneath and adjacent said soffit members.

3. An apparatus as defined in claim 2 further comprising a plurality of roof panels supported on a plurality of roof stands placed inwardly of said soffits, said plurality of roof panels including an outer set of panels extending over said soffit members for cooperative abutment with the top of said interior wall panels, said outer set of panels including an inclined surface extending upwardly and inwardly from said interior wall panels.

4. An apparatus as defined in claim 3 further comprising a form member overlying each of said interior wall panels having an inclined surface parallel to said inclined surface formed by said roof panels and orthogonal surfaces coplanar with the outer surfaces of said interior wall panels and roof panels.

5. An apparatus as defined in claim 4 further comprising means for detachably affixing said wall panels to said form members.

6. An apparatus as defined in claim 1 wherein said corner panel comprises first and second plate members affixed to each other in orthogonal relationship, said first and second plate members increasing concomitantly in width from the top thereof to the bottom thereof; first and second opposing plate members affixed respectively to said first and second orthogonal plate members along the outer longitudinal edges thereof and extending inwardly of said mold, each of said opposing plate members including an outer longitudinal edge portion extending coplanar with a respective one of said orthogonal plates; and a plurality of vertically spaced plates connecting said orthogonal plates and said opposing plates.

7. An apparatus as defined in claim 6 wherein said means for selectively moving comprises a fixed frame spaced from said corner panel and a plurality of link members pivotally connected between said frame and said corner panel with one of said links being selectively variable in length such that said corner panel is displaced responsive to the variation of length of said link.

8. An apparatus as defined in claim 7 wherein said variable length link is a linear actuator and wherein said plurality includes parallel spacing links extending between said frame and said corner panel.

9. An apparatus as defined in claim 1 wherein said means for selectively moving comprises a fixed frame spaced from said corner panel and a plurality of link members pivotally connected between said frame and said corner panel with one of said links being selectively variable in length such that said corner panel is displaced responsive to the variation of length of said link.

10. An apparatus as defined in claim 1 wherein said variable length link is a linear actuator and wherein said plurality includes parallel spacing links extending between said frame and said corner panel.

11. An apparatus as defined in claim 2 further comprising an internal waler including an upright member fixed in spaced relation to said soffit, said waler including a connection affixed to one of said wall panels and said upright member; and actuating means for moving said connector and panel relative to said upright member such that said wall panel is selectively moved between a mold open position pivoted away from said soffit and a mold closed position pivoted toward said soffit.

12. An apparatus as defined in claim 11 wherein said actuating means comprises a weldment including a horizontal pivot tube mounted transversely of said upright member and a pull tube secured in said weldment parallel and displaced from said pivot tube, said pull tube pivotally affixed to said connector and means for applying rotational force to said weldment to urge said pull tube in an arc about said pivot tube.

13. Apparatus for molding monolithic concrete building modules comprising:

(a) a plurality of exterior wall segments of predetermined width adapted for coplanar attachment into a plurality of exterior wall panels having a width substantially equal to the combined width of the segments therein, said plurality of wall panels defining an outer surface for a set of walls for a monolithic integral casting;

(b) a plurality of wall segments of predetermined width adapted for coplanar attachment into a plurality of interior wall panels having width substantially equal to the combined segments therein, said plurality of wall panels defining an inner surface for said set of walls;

(c) a plurality of soffit segments mounted at a predetermined height on a plurality of soffit brackets;

(d) hinge means pivotable about an axis beneath said soffit segments for mounting each of said plurality of interior wall panels inwardly of said soffit segments for limited inward movement;

(e) hinge means pivotable about a first axis located downwardly and outwardly of said soffit segments for mounting each of said plurality of exterior wall panels outwardly of said soffit segments for selective movement to a substantially horizontal open position displaced from said soffit segments and a closed position superjacent said soffit segments;

(f) a corner panel, defining a vertical right angle corner and mounted for movement generally downwardly and inwardly diagonally relative to said corner between a closed position intermediate and abutting orthogonal ones of said interior wall panels and an open position displaced inwardly from said interior wall panels sufficient to provide clearance of said interior wall panels relative to each other and said corner panel to permit concurrent inward movement of said interior wall panels.

14. An apparatus as defined in claim 13 wherein said corner panel comprises first and second plate members affixed to each other in orthogonal relationship, said first and second plate members increasing concomitantly in width from the top thereof to the bottom thereof; first and second opposing plate members affixed respectively to said first and second orthogonal plate members along the outer longitudinal edges thereof and extending inwardly of said mold, each of said opposing plate members including an outer longitudinal edge portion extending coplanar with a respective one of said orthogonal plates; and a plurality of vertically spaced plates connecting said orthogonal plates and said opposing plates.

15. An apparatus as defined in claim 13 further comprising a plurality of roof panels supported on a plurality of roof stands placed inwardly of said soffit segments, said plurality of roof panels including an outer set of panels extending over said soffit segments for cooperative abutment with the top of said interior wall panels, said outer set of panels including an inclined surface extending upwardly and inwardly from said wall panels.

16. An apparatus as defined in claim 15 further comprising a form member overlying each of said interior wall panels having an inclined surface parallel to said inclined surface formed by said roof panels and orthogonal surfaces coplanar with the outer surfaces of said interior wall panels and roof panels.

17. An apparatus as defined in claim 16 further comprising means for detachably affixing said wall panels to said form members.

18. An apparatus as defined in claim 13 further comprising means for selectively moving said corner panel including a fixed frame spaced from said corner panel and a plurality of link members pivotally connected between said frame and said corner panel with one of said links being selectively variable in length such that said corner panel is displaced responsive to the variation of length of said link.

* * * * *